United States Patent [19]

Hamajima et al.

[11] Patent Number: 4,739,817

[45] Date of Patent: Apr. 26, 1988

[54] METHOD FOR MANUFACTURING ALUMINUM ALLOY BY PERMEATING MOLTEN ALUMINUM ALLOY CONTAINING SILICON THROUGH PREFORM CONTAINING METALLIC OXIDE AND MORE FINELY DIVIDED SUBSTANCE

[75] Inventors: Kaneo Hamajima; Tadashi Dohnomoto; Atsuo Tanaka; Masahiro Kubo, all of Toyota, Japan

[73] Assignee: Toyota Jidosha Kabushiki Kaisha, Aichi, Japan

[21] Appl. No.: 32,522

[22] Filed: Mar. 31, 1987

[30] Foreign Application Priority Data

Apr. 7, 1986 [JP] Japan ..... 61-079568

[51] Int. Cl.[4] ..... B22D 19/14; C22C 1/09

[52] U.S. Cl. ..... 164/97; 164/54; 164/120; 420/590

[58] Field of Search ..... 164/97, 54, 120; 420/590

[56] References Cited

U.S. PATENT DOCUMENTS 4,492,265 1/1985 Donomoto et al. ..... 164/97 X
4,572,270 2/1986 Funatani et al. ..... 164/97

FOREIGN PATENT DOCUMENTS 59-53641 3/1984 Japan ..... 164/54
60-115360 6/1985 Japan ..... 164/97

*Primary Examiner*—Nicholas P. Godici

*Assistant Examiner*—J. Reed Batten, Jr.

*Attorney, Agent, or Firm*—Finnegan, Henderson, Farabow, Garrett & Dunner

[57] ABSTRACT

In this method for manufacturing an aluminum alloy, a porous preform is manufactured from a mixture of a finely divided oxide of a metallic element which has a weaker tendency to form oxide than does aluminum, and an additional substance substantially more finely divided than that metallic oxide. Then an aluminum alloy containing a substantial quantity of silicon is permeated in the molten state through the porous preform. This causes the metallic oxide to be reduced by a thermite reaction, to leave the metal which it included as alloyed with the aluminum alloy. At this time, the silicon in the aluminum alloy does not tend to crystallize out upon the particles of the metallic oxide, which would interfere with such a reduction reaction by forming crystalline silicon shells around such metallic oxide particles and would lead to a poor final product, because instead the silicon tends to crystallize out upon the particles of the additional substance. This alloying method is effective even if the average particle diameter of the finely divided metallic oxide, on the assumption that it is in the form of globular particles, is less than about 10 microns. The melting point of the additional substance should desirably be substantially higher than the melting point of the aluminum alloy. The silicon content of the aluminum alloy may freely be greater than about 1.65% by weight. Desirably, the preform may further contain reinforcing fibrous material. And, particularly, the additional substance may be $Al_2O_3$.

7 Claims, 2 Drawing Sheets

METHOD FOR MANUFACTURING ALUMINUM ALLOY BY PERMEATING MOLTEN ALUMINUM ALLOY CONTAINING SILICON THROUGH PREFORM CONTAINING METALLIC OXIDE AND MORE FINELY DIVIDED SUBSTANCE

BACKGROUND OF THE INVENTION

The present invention relates to a method for manufacturing an aluminum alloy, and more particularly relates to such a method for manufacturing an aluminum alloy through the use of a reduction type reaction.

Further, the present inventors wish hereby to attract the attention of the examining authorities to copending U.S. patent application Ser. Nos. 820,886 and 888,650, which may be considered to be material to the examination of the present patent application.

In the prior art, there have been proposed various types of method for manufacturing an aluminum alloy. In particular, in Japanese Patent Application Laying Open Publication Serial No. 59-256336 (1984), which it is not intended hereby to admit as prior art to the present patent application except to the extent in any case required by applicable law, there is disclosed a method for manufacturing an alloy of a first base metal which for example may be aluminum and a second additive metal which has a weaker affinity for oxygen than said first base metal (but may have a much higher melting point than said first base metal), in which a porous block like preform is made of an oxide of the second additive metal, and then a quantity of the first base metal in molten form is permeated through the interstices of this porous preform, so as to come into intimate contact with the material thereof which is the oxide of the second additive metal. As this occurs, said molten first base metal reduces this oxide of said second metal, due to the fact that said first metal has a greater affinity for oxygen, i.e. has a greater oxide formation tendency, than does said second metal. Accordingly, said oxide of said second additive metal is, hopefully, all reduced, so as to leave said second additive metal in alloyed form with said first base metal, while of course producing a certain quantity of the oxide of said first base metal which need not present any problem. And a distinguished advantage of this alloying process is that it is not necessary to raise the working temperature so high as to melt said second additive metal, which may be a very high melting point metal such as nickel or titanium or the like, but it is on the contrary only necessary to melt the first base metal which may be a relatively low melting point metal such as aluminum or aluminum alloy. And in the case of this alloying method there are no substantial limitations on the type or the quantity of the second additive metal which is to be alloyed to the first base metal, and it is thus possible to manufacture an alloy of any desired composition, as opposed to the case of a conventional type of allowing process in which there are various inevitable restrictions due to reasons including but not limited to rise in the dissolution temperature of the alloy or of its materials, degradation of alloying characteristics, and differences in the specific gravities of the materials to be alloyed. Further, in the case of the above outlined alloying method it is possible to regulate a specific part of a cast object to be of substantially any desired composition.

In the case of the above outlined alloying method, in the case that the first base metal is aluminum or an alloy thereof, the reduction of the second additive metal is brought about by means of a thermite reaction that occurs between the molten aluminum or aluminum alloy base metal and the oxide or oxides of the porous perform including the second additive metal. This enables the manufacture of aluminum alloys that may be of substantially any desired composition, and whose composition may be locally varied as desired.

However, there is a disadvantage with the above outlined alloying method in its form as described above, as follows. If a conventionally available aluminum alloy is selected as the first base metal to be alloyed, as is per se desirable on the grounds of cost and convenience, there are many cases in which a satisfactory thermite reaction is not produced, and there is in practice no assurance that a satisfactory alloying process will occur and that the first base metal and the second additive metal will be properly alloyed together and will be properly commingled. In detail, if substantially pure aluminum is used as the first base, metal, than no substantial problem tends to arise: thus, if pressurized infiltration of molten substantially pure aluminum alloy into a high porosity block formed of powdered oxide of another metal, such as $Fe_2O_3$, NiO, or MnO, which has a particle diameter of less than one micron, is conducted, then indeed a sufficiently effective thermite reaction occurs, and the powdered oxide of said other metal is indeed satisfactorily reduced, so as to produce a quantity of aluminum oxide which presents no substantial problem, and so as to release a quantity of said other metal, such as Fe, Ni, or Mn, into the aluminum alloy to be alloyed therewith. Thereby, the desired high quality alloy, such as an Al-Fe alloy, and Al-Ni alloy, or an Al-Mn alloy, can be satisfactorily produced. However, in the more common case that it is desired to utilized as the material for being infiltrated in said high porosity preform an alloy of aluminum containing a substantial amount of silicon, such as aluminum alloy of type JIS standard AC8b 8A, then there is a tendency for the silicon in the molten aluminum alloy mixture to crystallize out on the surfaces of the small particles of the oxide of the additive metal that make up the preform, and this can impede the thermite reaction between the aluminum alloy and said small oxide particles, and can result in the incomplete reduction of said oxide of said second additive metal. Experimental results verifying this phenomenon are presented later in the specification under the title of "Background Experiments". This can present a serious problem in circumstances of actual industrial application.

SUMMARY OF THE INVENTION

The inventors of the present invention have considered the various problems detailed above in the case when it is desired to utilize, as the molten first base metal for alloying, such an alloy of aluminum including silicon, from the point of view of the desirability of promoting the reduction reaction for the particles of the oxide of the second additive metal without any crystallization of silicon interfering with such reduction, and have discovered, as detailed later in this specification, that, if a quantity of another substance in a powder or other finely divided form, the particle size of which is even finer than the particle size of the oxide particles of the second additive metal, is added to the high porosity preform, then, during the process of infiltration by the aluminum alloy containing silicon, this silicon tends to crystallize out on the surfaces of said another substance in a preferential manner, and accordingly is prevented from crystallizing out upon the surfaces of the fine oxide powder particles. Accordingly, the thermite reaction between the aluminum alloy and said fine oxide powder particles is allowed to proceed to its culmination, and satisfactory alloying is enabled.

Accordingly, it is the primary object of the present invention to provide a method for manufacturing an aluminum alloy, of the type in which a molten aluminum alloy which may contain silicon is infiltrated into the interstices of a preform containing fine particles of an oxide of another metal to be alloyed with said aluminum alloy in order to reduce them, which avoids the problems detailed above.

It is a further object of the present invention to provide such a method for manufacturing an aluminum alloy, which prevents silicon crystallization from impeding the thermite reduction process of said oxide of another metal.

It is a further object of the present invention to provide such a method for manufacturing an aluminum alloy, which avoids poor integrity of the finished product.

It is further object of the present invention to provide such a method for manufacturing an aluminum alloy, which prevents the occurrence that particles of the oxide of the additive metal should remain in the finished product, perhaps as wholly or partly surrounded by shells of silicon.

According to the most general aspect of the present invention, these and other objects are attained by a method for manufacturing an aluminum alloy, wherein: (a) a porous preform is manufactured from a mixture of: (a1) a finely divided oxide of a metallic element which has a weaker tendency to form oxide than does aluminum, and: (a2) an additional substance substantially more finely divided than said metallic oxide; and: (b) an aluminum alloy containing a substantial quantity of silicon is permeated in the molten state through said porous preform. And the process described above is particularly beneficial, in the case that the average particle diameter of said finely divided metallic oxide, on the assumption that said finely divided metallic oxide is in the form of globular particles, is less than about 10 microns.

According to such a method for manufacturing an aluminum alloy as specified above, since the silicon in the aluminum alloy which is being permeated in the molten state through said porous preform tends preferentially to be crystallized out around the surfaces of the particles or flakes of said additional substance substantially more finely divided than said metallic oxide particles, therefore such silicon crystallization does not tend to occur to any great extent around the surfaces of the particles of the finely divided oxide of said metallic element, and accordingly the reduction reaction (or thermite reaction) between the molten aluminum alloy and said particles of said finely divided oxide of said metallic element is allowed to take place satisfactorily. This, in turn, facilitates the production of a satisfactory alloy of said aluminum alloy and said metallic element. Accordingly, poor integrity of the finished product is avoided, and this method for manufacturing an aluminum alloy therefore prevents the occurrence that particles of the oxide of the additive metal (said metallic element) should remain in the finished product perhaps as wholly or partly surrounded by shells of silicon.

According to the results of experiments performed by the present inventors, when the molten aluminum alloy containing silicon is being infiltrated in the molten state through the interstices of the porous preform, if the particles or flakes of said additional substance which are substantially more finely divided than said metallic oxide particles tend to be melted by the molten aluminum alloy, the desired object of the present invention cannot be satisfactorily attained. Thus, it is considered to be very desirable, if not absolutely essential, to the present invention for said particles or flakes of said additional substance to be left as remaining in a state of fine dispersion in the final aluminum alloy produced, so as to be able to serve as the nuclei for the crystallization of silicon as explained above. Therefore, according to a particular and much desired specialization of the present invention, the above and other objects may more particularly be accomplished by such a method for manufacturing an aluminum alloy as first specified above, wherein the melting point of said additional substance is substantially higher than the melting point of said aluminum alloy. In this case, there will be no problem of said particles or flakes of said additional substance becoming melted away during the alloy infiltration process, and it is ensured that said particles or flakes of said additional substance are finally left as remaining in a state of fine dispersion in the final aluminum alloy produced.

Further, according to the results of the various experiments performed by the present inventors, when the molten aluminum alloy containing silicon is being infiltrated in the molten state through the interstices of the porous preform, with regard to the risk identified above that the silicon in said molten aluminum alloy may crystallize out upon said metallic oxide particles, for the case of a bi elemental configuration in which the silicon content in the aluminum alloy is less than about 1.65% by weight, such silicon crystallization is not particularly likely to occur, although because of such factors as irregularities in the consistency or the density of such silicon content nevertheless some silicon crystallization may happen. However, the risk of this silicon crystallization phenomenon becomes much greater, when the silicon content in the aluminum alloy comes to be more than about 1.65% by weight. Accordingly, the above and other objects may even more desirably be accomplished by such a method for manufacturing an aluminum alloy as first specified above, when the silicon content of said aluminum alloy is greater than about 1.65% by weight.

Now, it has been further determined by the present inventors that, if reinforcing fiber material is contained in the preform, the aluminum alloy that is produced as a result of the process of the present invention is produced as a fiber reinforced alloy, i.e. as a reinforced material. By this method, at the same time as this aluminum alloy which has a completely new composition is produced via the thermite reaction explained above, it is at the same time and concurrently provided with fiber reinforcement; and this is very beneficial with regard to production effectiveness. Therefore, according to a further specialization of the present invention, the above and other objects may more particularly be accomplished by such a method for manufacturing an aluminum alloy as first specified above, wherein said preform further contains reinforcing fibrous material.

With regard to the material to be utilized for the aforementioned additional substance to be added to the preform, it has been particularly determined according to the results of the researches performed by the present inventors, as will be detailed shortly, that $Al_2O_3$ is particularly effective as said additional substance. Therefore, according to a yet further specialization of the present invention, the above and other objects may more particularly be accomplished by such a method for manufacturing an aluminum alloy as first specified above, wherein said additional substance is $Al_2O_3$.

Now, if as suggested above the preform should contain reinforcing fibrous material, at least a portion of this reinforcing fibrous material may also fulfill the role of the additional substance substantially more finely divided than said metallic oxide; in other words, if the fibers of said reinforcing fibrous substance are finer, i.e. are smaller in size, than the particles or flakes or the like of said metallic oxide, then they may fulfill the role of the additional substance for promoting silicon crystallization upon themselves. By employing this method, the reinforcing fibers that are utilized as said additional substance perform two separate and disparate functions concurrently: they function as nuclei for silicon crystallization during the alloying process, and also they provide fiber reinforcement for the finally produced aluminum alloy material. As a result of this, it is not usually necessary to mix in any other additional substance, other than said fine reinforcing fibrous material, into the high porosity preform which is to be infiltrated.

With regard to the amount of said additional substance which it is required to provide in said high porosity preform which is to be infiltrated with aluminum alloy containing silicon, it is desirable that this amount should be sufficient in order completely to prevent the crystallization of the silicon around the peripheral surfaces of the particles of the oxide of the additive metal. Even, however, if the amount of said additional substance which is provided is below this ideal value, the reduction thermite reaction between the aluminum alloy and the oxide of the additive material will be substantially promoted by such amount of said additional substance as in fact is provided. In other words, the intensity and the effectiveness of the thermite reaction generated increase, as the amount of said additional substance added to the preform is increased, up to the theoretically ideal amount therefor. In particular, when the oxide of the additive metal, and/or the amount of silicon present in the aluminum alloy for infiltration, are present only in relatively small quantities, nevertheless the reduction reaction can proceed satisfactorily, even if the additional substance contained in the preform is present only in a trace amount.

The forms of the oxide of the additive metal present in the preform, and of the additional substance included therein, are not restricted to the globular particulate form. These substances may also be provided in any finely divided forms, such as the flake form, the non continuous fiber form, or the ultra thin flake form. Also, the oxide of the additive metal is not to be considered as being limited to being a simple oxide; it could be a compound oxide, i.e. an oxide of higher order, as shown by example in some of the preferred embodiments which will be disclosed hereinafter.

BRIEF DESCRIPTIOM OF THE DRAWINGS

The present invention will now be described with respect to background experiments and with respect to the preferred embodiments thereof, and also with reference to the illustrative drawings appended hereto, which however are provided for the purposes of explanation and exemplification only, and are not intended to belimitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and so on in the various figures relating to one preferred embodiment or background experiment, and like parts and gaps and so on in figures relating to different preferred embodiments or background experiments; and:

DESCRIPTION OF BACKGROUND EXPERIMENTS

Before beginning the description of the preferred embodiments of the process for manufacturing an aluminum alloy of the present invention, it is appropriate to detail two of the sets of background experiments performed by the present inventors, relating to processes for manufacture of aluminum alloys not according to the present invention, by way of furnishing background as to the need for development of the process of manufacturing an aluminum alloy of the present invention.

The First Set of Background Experiments

Figure 1:
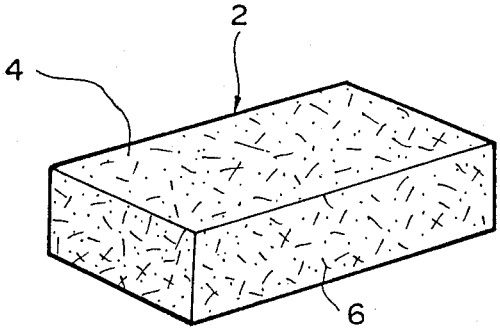
FIG. 1 is a schematic perspective view of a compacted preform, as used for the practice of any one of the background experiments or the preferred embodiments of the process for manufacturing an aluminum alloy of the present invention.

In the first one of this first set of experiments performed for the sake of background, a quantity of approximately 35 grams of NiO powder having an average particle diameter of approximately 2 microns was mixed to an even consistency with approximately 33 grams of alumina short fiber material of a type manufactured by ICI Co. Ltd. under the trademark "Saffil RF", and having average fiber length of about 3 mm and average fiber diameter of about 2 microns. The resultant mixture was than compacted under pressure, to produce a block shaped preform with dimensions of approximately 100 mm × 50 mm × 20 mm and of relatively high porosity; this preform had density of approximately 0.68 gm/cm$^3$. FIG. 1 is a perspective diagram of this preform, which is denoted as 2, and in this figure the reference numeral 4 denotes (schematically) the nickel oxide powder particles, while the reference numeral 6 denotes the alumina short fibers.

Figure 2:
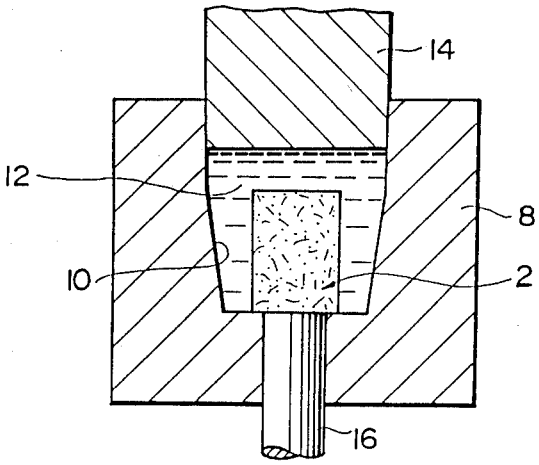
FIG. 2 is a schematic sectional view showing a pressure type alloy infiltration process, utilized in all said background experiments and said preferred embodiments of the process for manufacturing an aluminum alloy of the present invention.

Next, this high porosity preform 2 was preheated to a temperature of approximately 600° C. in an air chamber; and then, as shown in schematic sectional view in FIG. 2, said perform 2 was placed into a mold cavity 10 of a mold 8, and a quantity 12 of molten aluminum alloy of type JIS standard AC8A was poured into said mold cavity, over and around the preform 2. And then a pressure plunger 14 was inserted into the upper portion of the mold 8, so as to press on the upper surface of the molten aluminum alloy mass 12 and so as closely and slidingly to cooperate with said mold upper portion, and said pressure plunger 14 was pressed downwards, so as to pressurize the molten aluminum alloy mass 12 around the preform 2 to a pressure of about 1000 $kg/cm^2$. This pressure was maintained while said molten aluminum alloy mass 12 percolated and infiltrated into the interstices of the preform 2, and until said molten aluminum alloy mass 12 had completely solidified. Then the pressure plunger 14 was removed, and the solidified mass was removed from the mold cavity 10 of the mold 8 by being knocked out by a knock pin 16, and finally the portion of said solidified mass which corresponded to the original preform 2 was cut away from the rest of said solidified mass by means of a machine cutter.

Figure 3:
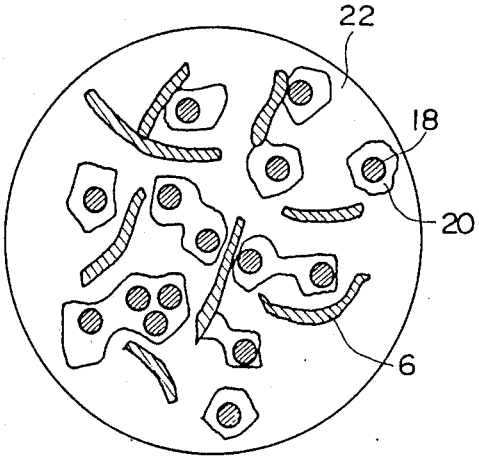
FIG. 3 PRIOR ART
FIG. 3 is a schematic enlarged optical microscope sectional view, showing the fine structure of an aluminum alloy material manufactured according to some of the background experiments, not according to the present invention.

When the fine structure of the resultant material was studied by cutting a cross section thereof and studying it under an optical microscope, as shown in FIG. 3 there remained fine particles of NiO therein, designated as 18 in the figure, and said fine NiO particles 18 were surrounded with coatings 20 of crystallized silicon. The present inventors indeed verified by means of EPMA analysis and X-ray diffraction analysis that these fine particles 18 were indeed particles of NiO. This resulted in a base structure somewhat segregated from the matrix aluminum alloy 22 which was formed as surrounding the reinforcing alumina short fibers 6. It was considered that this undesirable fine structure was due to the fact that some of the particles of the NiO powder initially served as nuclei for crystallization of a portion of the silicon in the matrix AC8A aluminum alloy, and this crystallized silicon subsequently shielded said particles from being completely subjected to the thermite reaction, so that they remained unchanged in the final material produced, and were not reduced.

Further, in two other background experiments similar to the one described above, as the aluminum alloy for infiltration into the porous preform 2, there were used, respectively, aluminum alloy of type JIS standard AC4C, and aluminum alloy of type JIS standard AC4A. The results were very similar to the above and as shown in cross sectional view in FIG. 3; the final material produced again contained a large number of NiO particles surrounded by silicon shells. Thus, the present inventors had again verified that some of the particles of the NiO powder had not been completely subjected to the thermite reaction, so that they remained unchanged in the final material produced and were not reduced.

Further, when in another background experiment similar to the one described above there was used for infiltration into the porous preform 2, substantially pure aluminum containing substantially no silicon admixture, upon investigation of the finished product it was confirmed that there were substantially no NiO particles left remaining therein, and that therefore substantially complete alloying the nickel of said NiO particles into the aluminum matrix had occurred along with reduction of said NiO particles by a thermite reaction, with of course a quantity of aluminum oxide being produced. In fact, the macro composition of the aluminum alloy formed in this manner was Al with an admixture of about 10.7% Ni.

As a result of these tests, the present inventors clarified the fact that, when the aluminum alloy used for infiltration into the porous preform has a comparatively large content of silicon, despite the structural formation of the final product that proceeds by means of a thermite reaction between the NiO particles and the aluminum in the aluminum alloy, due to the fact that the fine particles of NiO act as nuclei for the formation of silicon by crystallization, the is thermite reaction is not necessarily completed, and for these reasons there are instances in which complete and proper alloying is not achieved.

The Second Set of Background Experiments

In this second set of background experiments, seven types of NiO powder sample were used, having average particle diameters of approximately, respectively, 0.5, 1, 2, 3, 5, 10, and 15 microns. Using in each case as the molten material for infiltration a quantity of molten aluminum alloy of type JIS standard AC8A, substantially the same process as detailed above with regard to the first background experiment was carried out, for each such NiO powder sample, using the same quantities of NiO powder and other materials in each case. And in each case the resultant Al-Ni alloy material was examined, in the same manner as before.

When the fine structure of the resultant materials, in each of the seven test cases, was studied by cutting a cross section thereof and studying it under an optical microscope, and was further subjected to exhaustive EPMA analysis and X-ray diffraction analysis, it was determined that, when the average diameter of the NiO particles was less than about 10 microns, there were as before left some of these fine particles of NiO remaining in the matrix aluminum alloy 22 which was formed as surrounding the reinforcing alumina short fibers 6; and it was again determined that these remaining fine NiO particles were surrounded by crystallized silicon shells, which had presumably shielded said fine NiO particles from being reduced by the thermite reaction. However, it was determined that, if on the other hand the diameter of the NiO particles was greater than about 10 microns, no such problems tended to surface.

Further, in other background experiments similar to the one described above, as the oxide powder for incorporation into the porous preform 2, there were used, respectively, $Co_3O_4$ powder and $Fe_2O_3$ powder. The results were very similar to the above, and similarly indicated that, when the average diameter of the included oxide particles was less than about 10 microns, there were a before left some of these fine oxide particles remaining in the aluminum alloy which was formed; and it was again determined that these remaining fine oxide particles were surrounded by crystallized silicon shells, which had presumably shielded said fine oxide particles from being reduced by the thermite reaction.

As a result of these background tests, the present inventors clarified the fact that, when the aluminum alloy used for infiltration into the porous preform had a comparatively large content of silicon, regardless of the species of metallic element of which fine oxide particles were used for manufacture of the porous preform 2, when the average particle diameter of said oxide particles was less than about 10 microns (assuming a globular shape for said oxide particles), this typically caused a satisfactory thermite reaction to fail to occur, and a proportion at least of the fine oxide particles remained unreduced in the resultant material, and for these reasons there were instances in which complete and proper alloying was noted achieved.

DESCRIPTION OF THE PREFERRED EMBODIMENTS

The present invention will now be described with reference to the various sets of preferred embodiments thereof, and with reference to the figures.

The First Set Of Preferred Embodiments

The Process

For elaborating the first set of preferred embodiments of the method for manufacturing an aluminum alloy of the present invention, six experiments were conducted. Seven samples of each of six types of NiO powder having average particle diameters of approximately, respectively, 0.5, 1, 2, 3, 5, and 10 microns were prepared, thus providing forty-two samples in all, and six samples of each of seven types of $Al_2O_3$ powder (all with melting point approximately 2030° C.) having average particle diameters of approximately, respectively, 0.1, 0.5, 1, 2, 3, 5, and 10 microns were prepared, thus again providing forty-two samples in all. For all the forty-two combinations of particle diameters of the NiO powder and the $Al_2O_3$ powder, approximately 35 grams of the appropriate NiO powder and approximately 19.5 grams of the appropriate $Al_2O_3$ powder were taken and were thoroughly mixed together along with approximately 33 grams of the same type of alumina short fiber material as used in the first set of background experiments described above, and then as in said first background experiment set the resultant mixed material was pressure formed into a high density block shaped preform like that illustrated in FIG. 1 again having dimensions of approximately 100 mm×50 mm×20 mm and being of relatively high porosity; this preform had density of approximately 0.88 gm/cm$^3$.

Figure 4:
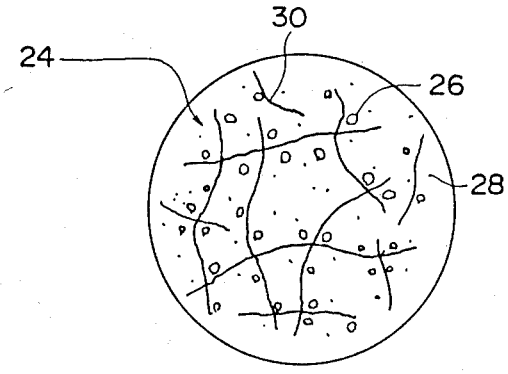
FIG. 4 is a schematic enlarged optical microscopic sectional view, showing a preform for use in the practice of the present invention.

FIG. 4 shows a cross section of a portion 24 of this high porosity preform, as enlarged under an optical microscope. In this figure, the reference numeral 26 shows the NiO powder, the reference numeral 28 denotes the $Al_2O_3$ powder, and the reference numeral 30 denotes the alumina short fibers, included in said preform portion 24.

Next, in each of the forty-two cases, a high pressure infiltration alloying process like to that performed in the case of the first set of background experiments described above, in each case using a quantity of aluminum alloy of type JIS standard AC8A (with a melting point of approximately 595° C.) as molten metal for infiltration into the interstices of the porous preform 2, was performed; in other words, the present inventors attempted to form an Al-Ni alloy under conditions and guidelines essentially the same as utilized previously.

The Results

In substantially the same way as before, the effectiveness of the alloying and reduction process were checked by means of X-ray diffraction tests, so as to check whether or not complete alloying had been accomplished. The results of these tests are presented in Table 1, which is given at the end of this specification and before the claims thereof in the interests of ease of pagination.

In this Table, for some particular ones of the tests, the sign "O" is used to indicate that no peaks for NiO were found as a result of the X-ray diffraction tests in these cases, although peaks for Ni and for $NiAl_3$ were determined. This indicates that the NiO particles in the original preforms 2 had in these cases been substantially completely reduced and alloyed into the aluminum alloy.

On the other hand, in the Table, for some other particular ones of the tests, the sign "X" is used to indicate that no peaks for NiO were found as a result of the X-ray diffraction tests in these cases, although peaks for Ni and for $NiAl_3$ were determined. This indicates that in these cases some of the NiO particles in the original preforms 2 remained after the pressure infiltration process, indicating that said NiO particles had not been completely reduced or alloyed into the aluminum alloy.

Further, by combining the "O" signs in Table 1, it becomes clear that in these cases the silicon in the original aluminum alloy, rather than crystallizing around the surfaces of the NiO particles as was the case in the background experiments detailed above, had instead in these cases crystallized around the surfaces of the $Al_2O_3$ powder particles, thus not causing any problem for the alloying process and instead allowing the thermite reduction reaction for the NiO particles to be completed satisfactorily.

It is noted that these cases, which are the satisfactory ones, are precisely those ones in which the average particle diameter of the $Al_2O_3$ powder particles included in the preform 2 was substantially less than the average particle diameter of the NiO particles included in said preform 2.

Further Related Tests

In addition to these tests described above, in other tests similar to the ones described above, as the oxide powder for incorporation into the porous preform 2, there were used, respectively, $Co_3O_4$ powder and $Fe_2O_3$ powder, instead of the NiO powder used in the forty-two tests detailed proximately above; and Al-Co and Al-Fe alloys were made in manners similar to the preceding. The results were very similar to the above, and similarly indicated that, when the average diameter of the included oxide particles (be they NiO particles, $Co_4O_4$ particles, or $Fe_2O_3$ particles) included in the high porosity preform was less than about 10 microns, provided that other fine particles were included in said high porosity preform which had particle diameters substantially less than said oxide particles, there was not left remaining in the aluminum alloy which was formed any substantial quantity of the fine oxide particles which had been surrounded by crystallized silicon shells, as had undesirably happened in the case of the background experiments as detailed above and which had in those cases presumably shielded said fine oxide particles from being reduced by the thermite reaction; and on the contrary said crystallized silicon shells had (it is hypothesized) tended to form instead on the other fine particles included in said high porisity preform, which had acted as preferential nuclei for silicon crystallization. Accordingly, it was enabled to be possible to manufacture a good, complete, and well integrated alloy of aluminum with the metallic material included in the oxide material of the fine particles, which were reduced by the thermite reaction which had occurred satisfactorily, even though the average particle size of said oxide particles was less than about 10 microns (assuming a globular shape for said oxide particles), and even though the aluminum alloy used for alloying contained a substantial amount of silicon admixtured with it.

The Second Set Of Preferred Embodiments

The Process

For elaborating the second set of preferred embodiments of the method for manufacturing an aluminum alloy of the present invention, twelve experiments were conducted. A sample of each of seven types of simple metallic oxide powder and also a sample of each of five types of compound metallic oxide powders were prepared, said twelve powders being of the types shown in Table 2 which is given at the end of this specification and before the claims thereof in the interests of ease of pagination, and having average particle diameters from approximately 1 micron to approximately 10 microns as shown in said Table and being prepared in quantities as also shown in said Table. Then, each of these twelve powder samples was mixed with approximately 19.5 grams of $Al_2O_3$ powder (all with melting point approximately 2030° C.) having average particle diameter substantially less than said sample, along with approximately 33 grams of the same type of alumina short fiber material as used in the first set of background experiment described above, and then as in said first background experiments set the resultant mixed material was pressure formed into a high density block shaped preform like the preform 2 illustrated in FIG. 1.

Next, in each of the twelve cases, a high pressure infiltration alloying process like to that performed in the case of the first set of background experiments described above, in each case again using a quantity of aluminum alloy of type JIS standard AC8A (with a melting point of approximately 595° C.) as molten metal for infiltration into the interstices of the porous perform 2, was performed; in other words, the present inventors attempted, by performing a thermite reduction reaction, to form an alloy between aluminum and the metallic material or materials included in the oxide particles of the preforms 2, under conditions and guidelines essentially the same as utilized previously.

The Results

In substantially the same way as before, the effectiveness of the alloying and reduction process were checked by means of X-ray diffraction tests, so as to check whether or not complete alloying had been accomplished. The results of these tests were that, in all of these cases, it was verified that the silicon in the original aluminum alloy, rather than crystallizing around the surfaces of the oxide particles as was the case in the background experiments detailed above, had instead in these cases crystallized around the surfaces of the $Al_2O_3$ powder particles, thus not causing any problem for the alloying process and instead allowing the thermite reduction reaction for the oxide particles to be completed satisfactorily. And it was verified that there was not left remaining in the aluminum alloy which was formed any substantial quantity of the fine oxide particles, as had undesirably happened in the case of the background experiments as detailed above. Accordingly, it was enabled to be possible to manufacture a good, complete, and well integrated alloy of aluminum with the metallic material or materials included in the oxide material of the fine particles, which were reduced by the thermite reaction which had occurred satisfactorily, even though the average particle size of said oxide particles was less than about 10 microns (assuming a globular shape for said oxide particles), and even though the aluminum alloy used for alloying contained a substantial amount of silicon admixtured with it. It is presumed that these satisfactory results were obtained because in each case the average particle diameter of the $Al_2O_3$ powder particles included in the preform 2 was substantially less than the average particle diameter of the oxide particles included in said preform 2.

Further Related Tests

In addition to these tests described above, in other tests similar to the ones described above, no admixture of $Al_2O_3$ powder particles was employed; and aluminum alloys were attempted to be made in manners similar to the preceding. The results indicated that in each case there was left remaining in the aluminum alloy which was formed substantial quantities of the fine oxide particles, which had been surrounded by crystallized silicon shells, which had presumably shielded said fine oxide particles from being reduced by the thermite reaction. Accordingly, it was not possible to manufacture a good, complete, or well integrated alloy of aluminum with the metallic material or materials included in the oxide material of the fine particles, since the thermite reaction was not able to proceed satisfactorily to its conclusion.

Thus, the present inventors clarified the fact that, regardless of the actual material incorporated in the quantity of fine particles of metallic oxide which was to be subjected to the reduction thermite reaction, if an admixture of even finer particles of another substance is added to the high porosity preform which is to be infiltrated in the high pressure infiltration alloying process, a complete and satisfactory alloying process can be accomplished even though there may be a substantial proportion of silicon in the aluminum alloy which is used for the pressure infiltration. It may also be inferred from these tests that the form of the fine oxide particles, while they were powder particles in the above preferred embodiments discussed, may in other cases be different; the fine oxide particles could be non continuous fibers, cut powder, ultra thin flakes, or of some other shape.

The Third Set Of Preferred Embodiments

The Process

For elaborating the third set of preferred embodiments of the method for manufacturing an aluminum alloy of the present invention, the following experiments were conducted. A sample of each of fourteen types of material for admixture was prepared, to be used instead of the $Al_2O_3$ powder utilized in the case of the second preferred embodiments described above: these materials for admixture are described in detail in Table 3, which is given at the end of this specification and before the claims thereof in the interests of ease of pagination, and it will be seen that some of these materials for admixture were powder materials, while others were whisker materials. These materials for admixture were prepared in quantities as also shown in said Table. Then, in order, each of these material samples for admixture was mixed with a quantity of one of the oxide powders which were detailed in Table 2 with regard to the second set of preferred embodiments of the process for manufacturing an aluminum alloy of the present invention, and processes substantially the same as utilized in said second preferred embodiment set were conducted, so as in each case to form an alloy between aluminum and the metallic material or materials included in the oxide particles, by a similar type of thermite reduction process, under conditions and guidelines essentially the same as utilized previously.

The Results

In substantially the same was as before, the effectiveness of these alloying and reduction processes were checked by means of X-ray diffraction tests, so as to check whether or not complete alloying had been accomplished. The results of these tests were that, in all of these cases, it was vertified that the silicon in the original aluminum alloy, rather than crystallizing around the surfaces of the oxide particles as was the case in the background experiments detailed above, had instead in these cases crystallized around the surfaces of the admixture powder particles or whiskers, thus not causing any problem for the alloying process and instead allowing the thermite reduction reaction for the oxide particles to be completed satisfactorily. And it was verified that there was not left remaining in the aluminum alloy which was formed any substantial quantity of the fine oxide particles, as had undesirably happened in the case of the background experiments as detailed above. Accordingly, it was again enabled to be possible to manufacture a good, complete, and well integrated alloy of aluminum with the metallic material or materials included in the oxide material of the fine particles, which were reduced by the thermite reaction which had occurred satisfactorily, even though the average particle size of said oxide particles was less than about 10 microns (assuming a globular shape for said oxide particles), and even though the aluminum alloy used for alloying contained a substantial amount of silicon admixtured with it. It is presumed that these satisfactory results were obtained because in each case the average particle diameter or corresponding dimensional parameter of the admixtured powder particles or whiskers included in the preform was substantially less than the average particle diameter of the oxide particles included in said preform.

Thus, the present inventors clarified the fact that, regardless of the actual details of the fine structure of the finely divided material incorporated in the quantity of admixed other substance which was added to the high porisity preform which was to be infiltrated in the high pressure infiltration alloying process, a complete and satisfactory alloying process can be accomplished even though there may be a substantial proportion of silicon in the aluminum alloy which is used for the pressure infiltration. It may also be inferred from these tests that the admixtured substance, so long as it remains unreacted and does not become dissolved into trace elements within the aluminum alloy, may be a compound—either a stable compound that does not react with aluminum or a compound that can react with aluminum—or any desired substance, such as for example a metallic material. Further, the form of the admixtured substance may in various cases be different from the powder form; said admixtured substance may be in the form of short non continuous fibers such as whiskers, or may be in some other form.

The Fourth Set Of Preferred Embodiments

The Process

For elaborating the fourth set of preferred embodiments of the method for manufacturing an aluminum alloy of the present invention, various sets of experiments were conducted. In each such experiment, a quantity of approximately 35 grams of NiO powder having average particle diameter of approximately 2 microns was mixed with approximately 33 grams of the same type of alumina short fiber material as used in the various sets of experiments described above, and this mixture was then further mixed with, in the various different cases, various different amounts of a type of $Al_2O_3$ powder having average particle diameter of approximately 0.5 microns, thus providing various mixed samples. In each case, the resultant mixed material was pressure formed into a high density block shaped preform like that illustrated in FIG. 1, and was subjected to a high pressure infiltration alloying process like to that performed in the case of the first set of background experiments described above, using quantities of aluminum alloy of various different types and various different JIS standards, i.e. containing various different amounts of silicon, as molten metal for infiltration into the interstices of the porous preforms. This was done to determine, for each case of a particular quantity of silicon present in the aluminum alloy which was pressure infiltrated into the interstices of the preforms, what was the minimum quantity of admixtured $Al_2O_3$ powder which was sufficient for providing complete alloying without any portions of the NiO oxide particles remaining in the finished product.

The Results

In substantially the same way as before, the effectiveness of the alloying the reduction process were checked by means of X-ray diffraction tests, so as to check whether or not complete alloying had been accomplished. The results of these tests are presented in Table 4, which is again given at the end of this specification and before the claims thereof in the interests of ease of pagination.

In this Table, for each type of aluminum alloy, there is shown the minimum quantity of admixtured $Al_2O_3$ powder which was sufficient for providing complete alloying without any portions of the NiO oxide particles remaining in the finished product, in order to ensure that the silicon in the original aluminum alloy, rather than crystallizing around the surfaces of the NiO particles as was the case in the background experiments detailed earlier in this specification, should instead crystallize around the surfaces of the $Al_2O_3$ powder particles, thus not causing any problem for the alloying process and instead allowing the thermite reduction reaction for the NiO particles to be completed satisfactorily. It may be seen from this Table that, when the aluminum alloy conformed to JIS standard AC1A, i.e. had a silicon content of approximately 1%, no particular amount of admixtured $Al_2O_3$ powder was required, since in fact no problem of silicon crystallization occurred even if no admixtured $Al_2O_3$ powder at all was utilized; and it is considered that this is because in this case the silicon content was less than the solution limit for silicon of alpha-$Al_2O_3$ (which is approximately 1.65% by weight). Complete alloying could therefore be achieved satisfactorily, even if no admixtured $Al_2O_3$ powder at all was utilized. This illustrates the point that the process for manufacturing an aluminum alloy of the present invention is particularly beneficial when the silicon content in the aluminum alloy utilized is greater than about 1.65% by weight.

Moreover from Table 4 it will be understood that, the greater is silicon content in the aluminum alloy utilized, the greater is the amount of admixtured $Al_2O_3$ powder required, in order to provide complete alloying without any portions of the NiO oxide particles remaining in the finished product. Therefore, it is seen that, according to a particular specialization of the process for manufacturing an aluminum alloy of the present invention, it is desirable to adjust the amount of the added material such as $Al_2O_3$ powder, according to the silicon content of the aluminum alloy utilized.

The required minimum quantities of admixtured $Al_2O_3$ powder which were just sufficient for providing complete alloying without any portions of the NiO oxide particles remaining in the finished product, and which are presented in Table 4, are in fact precisely the quantities of $Al_2O_3$ powder which are necessary to bring about a complete reaction of the NiO powder. However, even if the quantity of $Al_2O_3$ powder actually utilized is below the required minimum value for complete alloying without any portions of the NiO oxide particles remaining in the finished product, nevertheless it is clear that the admixture of such an inadequate amount of $Al_2O_3$ powder will still have the beneficial effect of promoting the reaction. The present inventors also verified that, when the quantity of admixtured $Al_2O_3$ powder was increased, the quantity of NiO powder that was reacted also increased. Particularly in cases wherein the quantity of NiO powder utilized and also the silicon content of the aluminum alloy utilized are both relatively small, the present inventors verified the fact that, even if the quantity of $Al_2O_3$ powder contained in the high porosity preform is only a small quantity such as a trace quantity, a very clear reaction promotion effect can be obtained.

Conclusion

In the experiments and preferred embodiments of the process for manufacturing an aluminum alloy of the present invention described above, in the high porosity preforms that were manufactured for being subjected to high pressure infiltration alloying, in addition to the oxide material utilized for being reduced to provide the material to be alloyed with the aluminum alloy, and in addition to the finely divided material such as $Al_2O_3$ powder that was used for providing crystallization nuclei for the silicon contained in the aluminum alloy, there were additionally contained alumina short fibers. However, these alumina short fibers are not considered to have made any substantial contribution to the oxygen reduction reaction by which the alloying was accomplished, but only functioned as reinforcing material for the preform block and then for the finally produced alloy material, which thus finally functioned as a matrix metal in cooperation with said alumina short fibers. The alumina short fibers, in other words, fulfilled the following quite distinct functions:

(a) they provided a skeleton material for the high porosity preform block, and functioned for helping with the adjustment of the density of the oxide material and the admixtured material such as $Al_2O_3$ powder, and further were helpful with the event distribution of said oxide material and said admixtured material; and:

(b) they functioned to reinforce the finally alloyed aluminum alloy with reinforcing material.

Therefore, the type, size, shape, and quantity of the added fiber material such as short alumina fiber material that is utilized, in addition to the oxide material utilized for being reduced to provide the material to be alloyed with the aluminum alloy, and in addition to the finely divided material such as $Al_2O_3$ powder that is used for providing crystallization nuclei for the silicon contained in the aluminum alloy, do not make any direct contribution to the process for manufacturing an aluminum alloy of the present invention. Any type of reinforcing fibers, such as for example alumina-silica short fibers, silicon carbide fibers, or carbon fibers might be used, instead of the alumina short fibers that were described in, for example, the second set of preferred embodiments. Furthermore, this additional reinforcing material does not have to be provided in the form of fibers; it could take the form of powder particles or ultra thin flake material, and moreover need not be provided at all: it would be perfectly possible to form the high porosity preforms without the use of any such reinforcing material, which is helpful for providing body but however is not essential. In the case of the fourth set of preferred embodiments described above, for example, if silicon carbide whiskers and silicon nitride whiskers are used instead of alumina short fibers, not only was complete alloying achieved, but these whiskers acted as reinforcing fibers, and the aluminum alloy that resulted from the alloying process was manufactured in situ as the matrix metal of a fiber reinforced metallic compound material.

Although the present invention has been shown and described in terms of the preferred embodiments thereof and in terms of the background experiments related thereto, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow after the Tables.

TABLE 1

| $Al_2O_3$ powder average particle diameter | NiO powder average particle diameter | | | | | |
|---|---|---|---|---|---|---|
| | 0.5 | 1 | 2 | 3 | 5 | 10 |
| 0.1 | O | O | O | O | O | O |
| 0.5 | X | O | O | O | O | O |
| 1 | X | X | O | O | O | O |
| 2 | X | X | X | O | O | O |
| 3 | X | X | X | X | O | O |
| 5 | X | X | X | X | X | O |
| 10 | X | X | X | X | X | X |

TABLE 2

| Oxide material | Average particle diameter (microns) | Quantity used (gm) |
|---|---|---|
| $Ta_2O_5$ | 5 | 44 |
| CoO | 3 | 29 |
| SnO | 4 | 32 |
| $Fe_2O_3$ | 5 | 26 |
| $WO_3$ | 5 | 36 |
| $V_2O_5$ | 8 | 17 |
| $Mn_3O_4$ | 10 | 24 |
| $Fe_2O_3.MnO_2$ | 5 | 26 |
| $Fe_2O_3.NiO$ | 2 | 31 |
| ZnO.PbO | 5 | 34 |
| CoO.NiO | 1 | 32 |
| $SnO.V_2O_5$ | 4 | 25 |

TABLE 3

| Admixtured material | Melting point | Average particle diameter (microns) | Quantity used (gm) |
|---|---|---|---|
| $SiO_2$ powder | 1610° C. | 0.3 | 12 |
| MgO powder | 2800° C. | 0.2 | 18 |
| $TiO_2$ powder | 1670° C. | 0.2 | 20 |
| SiC whiskers | (note 1) | (note 3) | 10 |
| VC powder | 3123° C. | 0.1 | 29 |
| $W_2C$ powder | 2800° C. | 0.1 | 86 |

TABLE 3-continued

| Admixtured material | Melting point | Average particle diameter (microns) | Quantity used (gm) |
|---|---|---|---|
| $Si_3N_4$ whiskers | (note 2) | (note 4) | 10 |
| BN powder | 2730° C. | 0.2 | 12 |
| Fe powder | 1536° C. | 0.5 | 39 |
| Ni powder | 1453° C. | 0.5 | 45 |
| Ti powder | 1680° C. | 0.5 | 24 |
| Co powder | 1492° C. | 0.3 | 45 |
| $Fe_2O_3$ powder | 1597° C. | 0.1 | 26 |
| NiO powder | 1984° C. | 0.2 | 35 |

note 1: 2700° C. (decomposition)
note 2: 1900° C. (decomposition)
note 3: average fiber diameter 0.2 microns, average fiber length 100 microns
note 4: average fiber diameter 0.3 microns, average fiber length 20 microns

TABLE 4

| Aluminum alloy Si content (wt %) | JIS standard satisfied | $Al_2O_3$ powder quantity required |
|---|---|---|
| 1% | AC1A | (none required) |
| 2% | (none) | 1 gram or more |
| 5% | AC4D | 6 grams or more |
| 7% | AC4C | 9 grams or more |
| 10% | AC4A | 15 grams or more |
| 12% | AC8A | 18 grams or more |

What is claimed is:

1. A method for manufacturing an aluminum alloy, comprising the steps of:

(a) forming a porous preform from a mixture of:

(a1) a finely divided oxide of a metallic element which has a weaker tendency to form oxide than does aluminum, and (a2) an additional substance substantially more finely divided than said metallic oxide;

and (b) permeating an aluminum alloy containing a substantial quantity of silicon in the molten state through said porous preform.

2. A method for manufacturing an aluminum alloy according to claim 1, wherein the average particle diameter of said finely divided metallic oxide is less than about 10 microns.

3. A method for manufacturing an aluminum alloy according to claim 1, wherein the melting point of said additional substance is substantially higher than the melting point of said aluminum alloy.

4. A method for manufacturing an aluminum alloy according to claim 1, wherein the silicon content of said aluminum alloy is greater than about 1.65% by weight.

5. A method for manufacturing an alumium alloy according to any one of claims 1 through 4, wherein said preform further contains reinforcing fibrous material.

6. A method for manufacturing an aluminum alloy according to any one of claims 1 through 4, wherein said additional substance is in fine fibrous form.

7. A method for manufacturing an aluminum alloy according to claim 1, wherein said additional substance comprises $Al_2O_3$.

* * * * *